US008684296B2

(12) United States Patent
Allerdings

(10) Patent No.: US 8,684,296 B2
(45) **Date of Patent: *Apr. 1, 2014**

(54) ROLLING SYSTEM FOR ROLLING STRIP-SHAPED ROLLING STOCK

(75) Inventor: Arthur Allerdings, Wenden-Altwenden (DE)

(73) Assignee: SMS Siemag AG, Düsseldorf (DE)

( * ) Notice: Subject to any disclaimer, the term of this patent is extended or adjusted under 35 U.S.C. 154(b) by 263 days.

This patent is subject to a terminal disclaimer.

(21) Appl. No.: 12/867,785

(22) PCT Filed: Jan. 29, 2009

(86) PCT No.: PCT/DE2009/000148

§ 371 (c)(1),
(2), (4) Date: Aug. 31, 2010

(87) PCT Pub. No.: WO2009/100705

PCT Pub. Date: Aug. 20, 2009

(65) Prior Publication Data

US 2010/0327101 A1 Dec. 30, 2010

(30) Foreign Application Priority Data

Feb. 15, 2008 (DE) ..... 10 2008 009 916

(51) Int. Cl.
*B65H 19/00* (2006.01)

(52) U.S. Cl.
USPC ..... 242/559; 242/560; 242/561

(58) Field of Classification Search
USPC ..... 242/558, 559, 560, 561
See application file for complete search history.

(56) References Cited

U.S. PATENT DOCUMENTS

| | | | | |
|---|---|---|---|---|
| 2,011,810 | A * | 8/1935 | Gardner et al. | 72/250 |
| 2,071,212 | A * | 2/1937 | Moore | 242/533.3 |
| 3,635,417 | A | 1/1972 | Kajiwara et al. | |
| 3,679,150 | A * | 7/1972 | Feuer et al. | 242/533.2 |
| 4,497,191 | A | 2/1985 | Langer et al. | |
| 5,706,690 | A | 1/1998 | Connolly | |
| 7,229,045 | B2 * | 6/2007 | Bucher et al. | 242/559 |
| 2004/0056140 | A1 * | 3/2004 | Brandli et al. | 242/559 |

FOREIGN PATENT DOCUMENTS

| | | |
|---|---|---|
| EP | 0 088 745 | 9/1983 |
| EP | 0 618 018 | 8/2001 |
| GB | 749 501 | 5/1956 |
| JP | 62 151209 | 7/1987 |

OTHER PUBLICATIONS

Guo et al., "Design and Simulation of an Entry Edge Guide Control System for Tandem Cold Mills" Transactions of the American Society of Mechanical Engineers, Series B: Journal of Engineering for Industry, ASME, New York US Bd. 121, Nr. 1, 1. Feb. 1999.

* cited by examiner

*Primary Examiner* — Sang Kim
(74) *Attorney, Agent, or Firm* — Cozen O'Connor

(57) ABSTRACT

A rolling installation for the rolling of in-process stock in the form of strip having a first reel, a second reel, with at least one stand between the reels, and with assigned coil transport trucks. Each reel is designed as a reversing reel, namely as an uncoiling and coiling reel.

10 Claims, 1 Drawing Sheet

ROLLING SYSTEM FOR ROLLING STRIP-SHAPED ROLLING STOCK

PRIORITY CLAIM

This is a U.S. national stage of application No. PCT/DE2009/000148, filed on Jan. 29, 2009, which claims Priority to the German Application No. 10 2008 009 916.3, filed: Feb. 15, 2008, the contents of both being incorporated herein by reference.

BACKGROUND OF THE INVENTION

1. Field of the Invention

The invention pertains to a rolling installation for the rolling of in-process stock in the form of a strip and a coil transport system.

2. Related Art

A rolling installation of this type is known from EP 618 018 B1 and JP 62 151209. These rolling installations can comprise a first reel and a second reel and at least one stand between the reels, wherein each reel is designed as a reversing reel, thus as both a coiler and decoiler.

A coil transport logistics system with coil transport trucks for transporting the coils to each of the reversing reels is known from GB 749 501.

Conventionally, rolling installations are designed with a special uncoiling reel and with at least one additional reel, usually with two additional reels. All arriving coils are set down on this one uncoiling reel. The departing coils are fetched from a different reel. There are also rolling installations in which all arriving coils are set down on one reel and fetched again from this same reel. In this case, the reel is both a coiling and an uncoiling reel.

Conventionally, the head of the strip is prepared in a special strip head preparation unit so that it can be threaded into the rolling installation. For this purpose, the head of the strip is uncoiled from the coil and transported to a nearby preparation unit. The head of the strip is given the desired shape in the coil preparation unit.

Conventionally, the uncoiling reel is equipped with a strip centering control system.

Conventionally, rolling installations are designed with a special coil transport truck to transport the coils to the uncoiling reel and with at least one additional coil transport truck to carry the coils away from the coiling reel. There are also rolling installations in which a coil transport truck sets all of the arriving coils down on one reel and also fetches them back again from this same reel.

SUMMARY OF THE INVENTION

A goal of the invention is to greatly simplify this type of rolling installation and thus to make it more economical and easier to operate.

In the case of a rolling installation for the rolling of in-process stock, in the form of a strip including a first reel, a second reel, at least one stand between the reels, and with coil transport trucks associated with the respective reels, according to one embodiment of the invention the reels are connected to coil transfer stations, and the coil transfer stations are connected to coil holding areas;

the coils can be delivered to the coil holding areas via rail-bound coil transport trucks, which travel in a direction perpendicular to the reels, and, for the transport of the coils to each of the reversing reels and for the removal of the coils from each of the reversing reels, the respective coil transport truck, which can be moved to and from each reversing reel, can be adjusted to a selected or current rolling direction of the rolling installation;

the coil transport trucks are connected to coil transfer stations for the transfer of the coils to the downline coil transport trucks, the downline coil transport trucks carrying the coils to the coil holding areas;

for the coil holding areas for coils to be rolled or coils which have already been finish-rolled can be controlled, a transversely-traveling rail-bound transport truck, which connects the coil transfer stations together, is provided; and the coil transport trucks and the transverse transport truck and the coil transfer stations can preferably rotate around 180° to turn the arriving coils and the rolled coils as a function of the current rolling direction of the rolling installation and as a function of the arrangement of coils in the coil entry section and in the coil exit section.

In the case of a rolling installation for the rolling of in-process stock in the form of strip with a first reel, with a second reel, with at least one stand between the reels, and with assigned coil transport trucks, according to one embodiment of the invention each reel is designed as a reversing reel, namely, as both an uncoiling and a coiling reel.

Both reels are preferably provided with devices for peeling the head of the strip from the coil, for coiling up the head of the strip, and for threading the strip to be rolled into a stand.

The rolling installation can be a one-way or a reversing installation.

According to one embodiment of the invention includes a rolling installation with two reversing reels and with at least one rolling stand. The invention also pertains to the design of the rolling installation which makes it possible to prepare the head of the strip on the reversing reel so that the strip can be threaded. The invention also pertains to the design of the rolling installation with coil a transport logistics system or a transport system that make it possible to deliver the coils alternately or in any desired sequence onto one or the other reversing reel, to roll the stock, and to remove the coils alternately or in any desired sequence from one or the other reversing reel.

According to one embodiment of the invention the strip transport logistics make it possible in cases where there are several coiling reels to transport the coils transversely and thus to make do with the coil transport devices provided in common.

BRIEF DESCRIPTION OF THE DRAWINGS

The invention is to be explained in greater detail below with reference to the drawings in which.

DETAILED DESCRIPTION OF THE DRAWINGS

The rolling installation is preferably designed with two equivalent reels, that is, without any special uncoiling reels, coiling reels, or uncoiling and coiling reels. Both of the reels 1, 17 of the rolling installation can serve as uncoiling reels, as coiling reels, and as reversing reels (coiling and uncoiling reels). As a result, arriving coils can be set down on the reel which served as the uncoiling reel during the last rolling cycle. When the end of the strip leaves this reel, the new coil can be pushed onto the reel's empty mandrel. While the rolled strip is being threaded out of the rolling train and carried away, the beginning of the strip of the new coil can be prepared for threading and threaded in or simply threaded in directly. Thus the head of the strip of the new strip can be threaded in directly behind the end or with the end of the rolled strip. If the number of passes through the rolling train is even, the arriving coils will be set down first on the one reel, then on the other.

Figure 1:
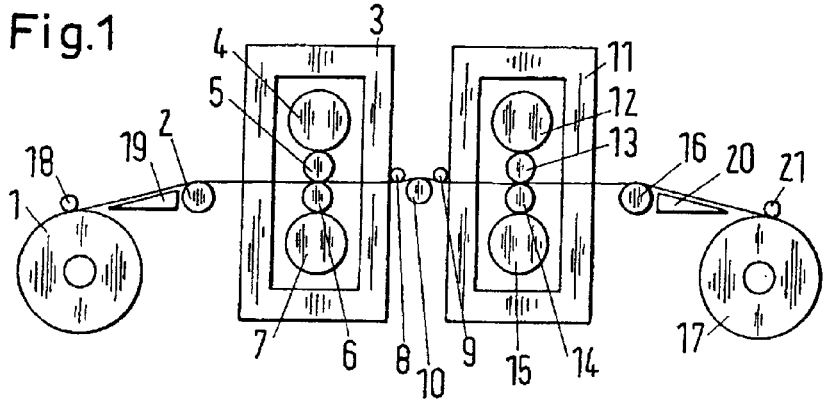
FIG. 1 is a schematic diagram of a rolling installation with two reels and two stands.

FIG. 1 is a design of the rolling installation with two stands 3 and 11. The rolling installation can be designed either with one stand or with several stands. The stands can be operated in either one-way or reversing mode.

In FIG. 1, the support rolls are designated 4, 7, 12, and 15, whereas the work rolls are designated 5, 6, 13, and 14. The stands can also contain additional rolls (e.g., intermediate rolls).

Strip guide rolls, e.g., roll 10, hold-down rolls 8, 9, and strip tension measuring rolls can be provided between the two reversing stands.

Figure 2:
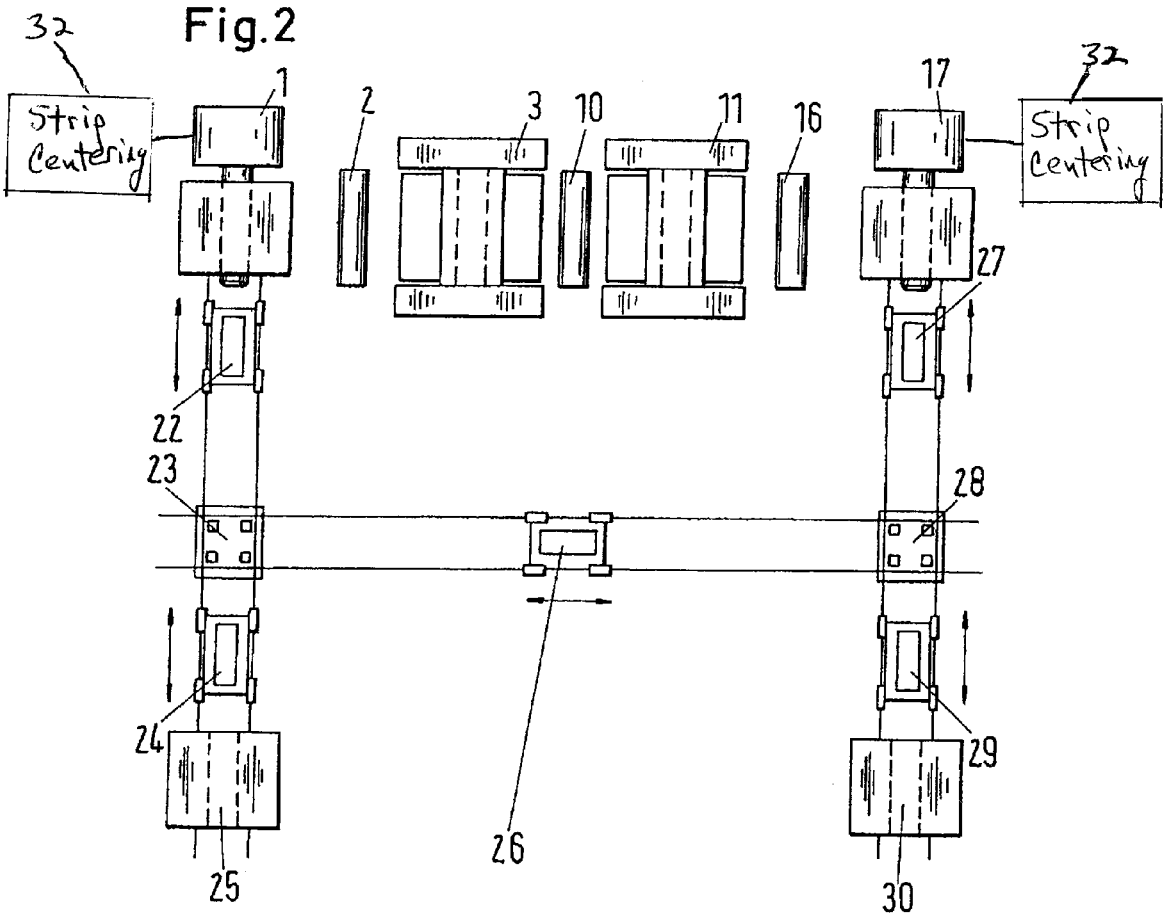
FIG. 2 is a schematic diagram of the coil transport system.

In the rolling installation, the movable strip transfer table 19, 20, one of which is located between the each reversing reel 1, 17 and the associated deflecting roll 2, 16, and movable back-up roll 18, 21 can be designed in such a way that the head of the strip can be peeled from the coil and simultaneously prepared for threading-in. Both of the coil transport trucks 22, 27 of the coil transport logistics system, shown in FIG. 2, can serve to transport coils to or from their associated reels 1, 17. As a result, the arriving coils can be delivered to the reversing reel which served as the uncoiling reel during the prior rolling cycle. The departing coils can be fetched from the reversing reel which served as the coiling reel during the last rolling cycle. One or both of the reels 1, 17 may be equipped with a strip centering control device 32 configured to maintain the strip to be rolled at the center of the rolling installation.

The coil transport trucks 24, 29 of the coil transport logistics system can be used to transport the coils from the coil holding areas 25, 30. The coil transport trucks 24, 29 of the coil transport logistics system can be used to transport these coils to the coil holding areas 25, 30. As a result, the coil transport trucks 24, 29 can be used to transport either the arriving coils or the rolled coils. The coil transport trucks 24, 29 can also be replaced by other transport devices such as walking beams.

The coil transport truck 26, a transversely traveling truck, of the coil transport logistics system can be used to transport coils between the two coil transfer points 23, 28. As a result, an arriving coil can be transferred from one of the coil transport trucks 24, 29 to either of the two reels 17, 1. The rolled coils, furthermore, can also be transferred from a reversing reel 1, 17 to either coil transport truck 29, 24. The coil transport truck 26 of the coil transport logistics can also be used, if desired, to rotate the coils by 180°. As a result, an arriving coil can be transferred from a coil transport truck 24, 29 to either of the two reversing reels 17, 1 with the head of the strip in the correct position. Similarly, the rolled coils can also be transferred from a reversing reel 1, 17 to either of the two coil transport trucks 29, 24 with the head of the strip in the correct position.

The coil transfer points 23, 28 can be designed as separate coil holding areas, or, in cases where the coils are taken over directly from the coil transport trucks 24, 29 or are transferred to the coil transport trucks 22, 27 by the coil transport truck 26, they can serve merely as transfer points.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A rolling installation for rolling in-process coil strip stock comprising:

a first reel configured as a reversing reel;

a second reel configured as a reversing reel;

at least one stand between the first and second reels;

a first holding area associated with the first reel;

a first transfer point between the first holding area and the first reel;

a second holding area associated with the second reel;

a second transfer point between the second holding area and the second reel; and a coil transport rail system settable to a selected or current rolling direction of the rolling installation, the coil transport rail system comprising:

a first coil transport truck configured to traverse a first rail between the first reel and the first transfer point, the first rail being substantially perpendicular to a strip stock travel direction between the first reel and the second reel;

a second coil transport truck configured to traverse a second rail between the first transfer point and the first holding area, the second rail being substantially perpendicular to the strip stock travel direction;

a third coil transport truck configured to traverse a third rail between the second reel and the second transfer point, the third rail being substantially perpendicular to the strip stock travel direction;

a fourth coil transport truck configured to traverse a fourth rail between the second transfer point and the second holding area, the fourth rail being substantially perpendicular to the strip stock travel direction; and a fifth coil transport truck configured to traverse a fifth rail between the first transfer point and the second transfer point, the fifth rail being substantially parallel to the strip stock travel direction, to control the deposit of coils to be rolled or coils already rolled to a finished state, wherein the fifth coil transport truck, the first coil transfer station, and the second coil transfer station are each configured to rotate 180° to turn one of an arriving coil and a rolled coil based at least in part on a rolling direction of the rolling installation and an arrangement of coils in a coil entry section and a coil exit section.

2. The rolling installation according to claim 1, further comprising:

a first device associated with the first reel configured to peel a head of the strip from the coil;

a second device associated with the first reel configured to coil the head of the strip;

a third device associated with the first reel configured to thread the strip to be rolled into a first reversing stand;

a fourth device associated with the second reel configured to peel a head of the strip from the coil;

a fifth device associated with the second reel configured to coil the head of the strip; and a sixth device associated with the second reel configured to thread the strip to be rolled into second reversing stand.

3. The rolling installation according claim 2, further comprising:

a first movable transfer table and a first movable back-up roll associated with the first reel and configured to prebend the head of the strip for threading into the first reversing stand; and a second movable transfer table and a second movable back-up roll associated with the second reel and configured to prebend the head of the strip for threading into the second reversing stand.

4. The rolling installation according to claim 1, wherein the first and the second reels are mounted moveable in an axial direction.

5. The rolling installation according to claim 1, wherein the first and the second reels are equipped with a strip centering control device configured to maintain the strip to be rolled in a center of the rolling installation.

6. The rolling installation according to claim 1, wherein each of the first and the second reel is configured as a coiling and uncoiling reel.

7. The rolling installation according to claim 6, further comprising:

a first device associated with at least one of the first reel and the second reel configured to peel a head of the strip from the coil;

a second device associated with at least one of the first reel and the second reel configured to coil the head of the strip; and a third device associated with at least one of the first reel and the second reel configured to thread the strip to be rolled into a reversing stand.

8. The rolling installation according claim 7, further comprising:

a first movable transfer table and a first movable back-up roll associated with at least one of the first reel and the second reel and configured to prebend the head of the strip for threading into the first reversing stand.

9. The rolling installation according to claim 8, wherein at least one of the first reel and the second reel is equipped with a strip centering control device configured to maintain the strip to be rolled in a center of the rolling installation.

10. The rolling installation according to claim 9, wherein the first and the second reels are mounted moveable in an axial direction.

* * * * *